United States Patent [19]

Mizutani et al.

[11] 4,102,824

[45] Jul. 25, 1978

[54] NON-AQUEOUS DETERGENT COMPOSITION

[75] Inventors: Hiroshi Mizutani, Yachiyo; Masaru Tamura, Sakura; Katsumi Saegusa, Funabashi, all of Japan

[73] Assignee: Kao Soap Co., Ltd., Tokyo, Japan

[21] Appl. No.: 807,182

[22] Filed: Jun. 16, 1977

[30] Foreign Application Priority Data

Jun. 25, 1976 [JP] Japan ..... 51-75346

[51] Int. Cl.[2] ..... C11D 1/22; C11D 3/30; C11D 7/50

[52] U.S. Cl. ..... 252/545; 252/153; 252/171; 252/548; 252/557; 252/558; 252/559

[58] Field of Search ..... 252/545, 548, 153, 557, 252/558, 559, 171; 8/142

[56] References Cited

U.S. PATENT DOCUMENTS

| | | | |
|---|---|---|---|
| 3,310,498 | 3/1967 | Michaels et al. | 252/548 |
| 3,310,499 | 3/1967 | Michaels et al. | 252/548 |
| 3,539,522 | 11/1970 | Lindner | 252/153 |
| 3,630,935 | 12/1971 | Potter | 252/153 |
| 3,642,644 | 2/1972 | Grote et al. | 252/153 |

*Primary Examiner*—P.E. Willis, Jr.
*Attorney, Agent, or Firm*—Blanchard, Flynn, Thiel, Boutell & Tanis

[57] ABSTRACT

A dry cleaning composition comprising from 5 to 50 percent by weight of dialkyl ($C_2$ to $C_4$) alkanol ($C_2$ or $C_3$) amine salt of linear alkyl ($C_{10}$ to $C_{16}$) benzenesulfonic acid, from 30 to 60 percent by weight of other surfactant useful for dry cleaning and the balance is essentially an organic solvent for dry cleaning.

8 Claims, 2 Drawing Figures

NON-AQUEOUS DETERGENT COMPOSITION

BACKGROUND OF THE INVENTION

1. Field of the Invention

The present invention relates to a detergent composition for use in non-aqueous cleaning. More particularly, the invention relates to a detergent composition for use in non-aqueous cleaning of clothes, such as dry cleaning.

2. Description of the Prior Art

One of the roles of a detergent used in dry cleaning is the solubilization of water. The purposes of the solubilization of water are to remove water-soluble stains from clothes into the water solubilized by the action of the detergent into a dry cleaning organic solvent (such as a petroleum type solvent, Perclene (tetrachloroethylene) or a fluorine type solvent) and to protect the clothes from shrinkage, deformation and color fading caused by water. Another purpose is to minimize the increase of the pressure of a filter for filtering the washing liquid by solubilizing water introduced with the clothes into the washing bath. It is logical that detergents for achieving the foregoing purposes should have a high water solubility, namely, a capacity of solubilizing a large quantity of water into an organic solvent.

As surface active agents of a detergent that can be used for achieving the foregoing purposes, there can be mentioned anionic surface active agents such as petroleum sulfonates, dialkylsulfosuccinic acid esters, long chain alkylbenzenesulfonic acid salts, non-ionic surface active agents such as polyoxyethylene nonylphenyl ethers, fatty acid sorbitan esters, fatty acid alkylolamides and polyoxyethylene alkyl ethers, and amphoteric surface active agents such as imidazoline-type alkylbetaines.

Petroleum sulfonates are obtained as by-products during the process of refining petroleum and they have heretofore been used frequently. However, because of process limitations, they are dark brown in color. Therefore, the use of such surface active agents is limited because there is a fear that the washed clothes will be colored by the surface active agent remaining in the clothes. Dialkylsulfosuccinic acid esters, which comprise one class of a limited number of surface active agents which are soluble in organic solvents, are frequently used in this field. However, the water solubilizing property thereof is very highly dependent on temperature and such an agent cannot be used alone. Various non-ionic surface active agents with optimum HLB values are also used in this field. However, since the temperature dependency of the water solubilizing property thereof also is high, they are used only in combination with other surface active agents. Among the long chain alkylbenzenesulfonic acid salts, the so-called hard-type (branched chain-type) alkylbenzenesulfonic acid salts are soluble in organic solvents, even if they are alkali metal salts, and they are used as non-aqueous detergents. However, because it is difficult to decompose them biologically, they will not be able to be used in the future. Alkali metal salts of linear alkylbenzenesulfonic acids having 10 to 16 carbon atoms in the alkyl group, which are used in large quantities as water-soluble detergents, are poorly soluble in organic solvents. Accordingly, these linear alkylbenzenesulfonic acids are used for non-aqueous cleaning in the form of their lower amine or lower alkanolamine salts. Propylamine, dipropylamine and butylamine are often used as the counter ion of these amine salts, but they have a low boiling point and are quite volatile, and they are inflammable and have a high toxicity. The use of these lower amine salts is not preferred in view of the difficulties of the preparation process and also in view of the properties of the resulting composition. Lower alkanolamine salts are still insufficient in their solubility in organic solvents, and they are poorly dissolved in petroleum-type solvents having a low solubility and therefore, they cannot be used conveniently.

It is a primary object of the present invention to provide a detergent composition having a high water solubilizing power, which can be prepared very easily and in which the foregoing disadvantages of the conventional detergents can be eliminated.

SUMMARY OF THE INVENTION

More specifically, in accordance with the present invention, there is provided a dry cleaning detergent composition comprising 5 to 50 percent by weight of a salt of a linear long chain alkylbenzenesulfonic acid having 10 to 16 carbon atoms in the alkyl group with a dialkylalkanolamine having the formula (1):

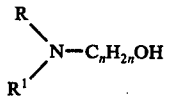

$$R_{R^1}N-C_nH_{2n}OH \quad (1)$$

wherein R and $R^1$, which can be the same or different, are linear or branched alkyls having 2 to 4 carbon atoms and $n$ is 2 or 3.

The number of carbon atoms of the alkyl group of the linear long chain alkylbenzenesulfonic acid is 10 to 16, preferably 12 to 14. If the carbon atom number is smaller than 10, the hydrophilic property is too high and the solubility thereof in an organic solvent is reduced. If the carbon atom number is larger than 16, the solubility thereof in an organic solvent is enhanced, but the hydrophobic property becomes too high and the water solubilizing property is degraded.

As examples of the dialkylalkanolamine of the formula (1), there can be mentioned diethylethanolamine, ethylbutylethanolamine, propylbutylethanolamine, dipropylethanolamine, dibutylethanolamine, diethylisopropanolamine, dipropylisopropanolamine, diisopropylisopropanolamine, dibutylisopropanolamine and diisobutylisopropanolamine.

Salts of compounds of the above formula (1) in which R and $R^1$ are H or $CH_3$ are too hydrophilic, and they are poorly soluble in an organic solvent when used alone. Salts of compounds of the above formula (1) in which R and $R^1$ are alkyls having 5 or more of carbon atoms or aryls having 6 or more of carbon atoms are highly soluble in an organic solvent, but they are too hydrophobic and the water-solubility thereof is degraded. Accordingly, the latter salts cannot be used.

Preferred examples of the dialkylalkanolamines of the above formula (1) are as follows:

(i) Dialkylisopropanolamines (the alkyl group is the same as defined in the formula (1)).

(ii) Dialkylethanolamines having the following formula (2):

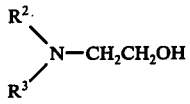

(2)

wherein $R^2$ and $R^3$ are linear or branched alkyls having 3 to 4 carbon atoms.

The dialkylalkanolamine salt of the linear long chain alkylbenzenesulfonic acid is colored only lightly and has only a slight odor, and it is preferred as a component of a dry cleaning detergent composition. Sulfuric acid is contained, as an impurity, in commercially available linear long-chain alkylbenzenesulfonic acids, but it is preferred that the content of sulfuric acid is as low as possible, namely, lower than 0.8 wt.% (based on the weight of the alkylbenzenesulfonic acid).

It is preferred that other surface active agents are used in combination with the dialkylalkanolamine salt of the linear long chain alkylbenzenesulfonic acid of the present invention. As such surface active agents, there can be mentioned anionic and non-ionic surface active agents. As the anionic surface active agents, there can be mentioned, for example, alkylbenzenesulfonic acid salts, petroleum sulfonates and dialkylsulfosuccinic acid salts. As the non-ionic surface active agent, there can be mentioned, for example, polyoxyethylene nonylphenyl ethers having 2 to 20 moles of added ethylene oxide units, polyoxyethylene alkyl ethers having 2 to 20 moles of added ethylene oxide units and $C_{10}$ to $C_{20}$ alkyl group, fatty acid sorbitan esters and fatty acid alkylolamides derived from $C_{10}$ to $C_{20}$ fatty acids and an alkylolamine selected from the group consisting of monoethanolamine, diethanolamine, monoisopropanolamine and diisopropanolamine. These surface active agents can be added in conventional amounts. Salts having a lower alkanolamine or a sodium or potassium ion as the counter ion of the long chain alkylbenzenesulfonic acid have a higher hydrophilic property and are poorly soluble in an organic solvent, but they can be used as an agent for adjusting the HLB value of the detergent up to a level suitable for the solvent used. As the lower alkanolamine for forming such salts, there can be mentioned monoethanolamine, diethanolamine, triethanolamine, monoisopropanolamine, diisopropanolamine and triisopropanolamine. The alkyl group of the dialkylsulfosuccinic acid salt has 6 to 10 carbon atoms. Preferred examples of such salts include sodium di-2-ethylhexylsulfosuccinate, sodium di-n-octylsulfosuccinate and sodium didecylsulfosuccinate.

A lower alkyl glycol ether can be used as an auxiliary component for enhancing the solubilizing rate and controlling the HLB value of the detergent. As preferred examples of such lower alkyl glycol ethers, there can be mentioned propyl cellosolve, propyl carbitol, butyl cellosolve and butyl carbitol. Fluorescent dyes, perfumes, dyes and water can be incorporated in appropriate conventional amounts as auxiliary components in the detergent composition of the present invention.

According to the present invention, the amount of the dialkylalkanolamine salt of the linear long chain alkylbenzenesulfonic acid is 5 to 50 wt.%, preferably 10 to 40 wt.%, based on the total weight of the composition. The solubility of the surface active agent in the organic solvent and the water solubilizing property of the solution are delicately changed depending on the required HLB value of the solvent and the HLB value of the surface active agent. Because the ratio between paraffinic and aromatic components contained in a petroleum solvent is not constant, the solubility of the detergent in the solvent can change remarkably. In Perclene-type solvents, the solubility is especially greatly changed. In detergents comprising the dialkylalkanolamine salt of the linear long chain alkylbenzenesulfonic acid of the present invention, a high water solubility can be maintained in a broad temperature range (0° to 50° C) either for removal of stains (in a solution having a detergent concentration of about 10 wt.%) or for washing (in a solution having a detergent concentration of about 1 wt.%). Accordingly, this salt can be effectively used in combination with other surface active agents. It is ordinarily preferred that 5 to 50% of the dialkylalkanolamine salt of the linear long chain alkylbenzenesulfonic acid is used in combination with 30 to 60 wt.% of another surface active agent. The proportion of the dialkylalkanolamine salt of the linear long chain alkylbenzenesulfonic acid is preferably from 30 to 70 weight percent, based on the sum of all of the surface active agents in the composition. This proportion can be changed depending on the chain length of the dialkylalkanolamine, the hydrophilic property of the other surface active agent or agents used in the composition and the kind of solvent used. The concentration of the active ingredients of the detergent is adjusted in the range of about 35 to about 80 wt.% (the balance being the solvent to be used in washing) appropriately, depending on the concentration of the detergent composition, the required water solubility and the required detergency.

Organic solvents for dry cleaning to be used in this invention include petroleum solvents such as benzine and mineral spirit and perclene type solvents such as perchloroethylene, trichloroethane and carbon tetrachloride.

The present invention will now be described in more detail by reference to the following illustrative Examples.

EXAMPLE 1

Various dry cleaning detergent compositions were prepared and they were tested with respect to their water solubility, detergency and the state of the solution.

Water Solubility Tests (1) Ten cc of a 1% detergent solution (in a petroleum type solvent) was charged into a glass test tube and water was added in small amounts with a microsyringe, and the mixture was shaken and the turbidity of the liquid was observed. This procedure was repeated until the liquid became turbid, and the total amount of water added up to just before the liquid became turbid is defined as the solubilized amount.

(2) Ten cc of a 10% detergent solution (in a petroleum type solvent) was charged into a glass test tube and water was titrated with a buret, and the change of the transparency of the liquid was observed under shaking. The amount of water added up to just before the liquid became turbid is defined as the solubilized amount.

Detergency Test

A soiled cloth (5 cm × 10 cm) made by dipping a piece of cloth in soy sauce was washed by a 1% detergent solution (in a petroleum type solvent) at 25° C for 10 minutes in a Launder-O-Meter. Rinsing was omitted. The detergency was determined from the reflectivities of the soiled cloth before and after washing.

The results obtained are shown in Table 1.

Table 1

| | Detergents | | | | |
|---|---|---|---|---|---|
| | A | B | C | D | E |
| | | | | (control) | (control) |
| LAS* dibutylethanolamine salt | 30% | — | — | — | — |
| LAS dipropylethanolamine salt | — | 30% | — | — | — |
| LAS diethylethanolamine salt | — | — | 30% | — | — |
| LAS dimethylethanolamine salt | — | — | — | 30% | — |
| LAS diamylethanolamine salt | — | — | — | — | 30% |
| polyoxyethylene (5 moles) nonylphenyl ether | 20% | 20% | 20% | 20% | 20% |
| dioctyl sulfosuccinate | 20% | 20% | 20% | 20% | 20% |
| petroleum type solvent | 30% | 30% | 30% | 30% | 30% |
| water solubility (maximum % by weight*) at 1% concentration | 0.50 | 0.48 | 0.40 | — | 0.05 |
| water solubility (maximum % by weight*) at 10% concentration | 14 | 13 | 11 | — | 1 |
| detergency for water-soluble stains | 85 | 83 | 75 | — | 20 |
| state of solution | trans-parent | trans-parent | trans-parent | trans-parent | trans-parent |

*LAS means linear dodecylbenzenesulfonic acid.
"Water solubility (maximum % by weight*) at 1% concentration" means parts of water dissolved in 100 parts of 1% detergent composition solution in a solvent.

As will be apparent from the results shown in Table 1, LAS dimethylethanolamine salt has too high a hydrophilic property and the water solubility is low, and therefore, it cannot be used conveniently. LAS diamylethanolamine salt is too oleophilic and the solubility is high, but the water solubility is degraded. On the other hand, LAS dibutylethanolamine salt, LAS dipropylethanolamine salt and LAS diethylethanolamine salt have excellent properties.

EXAMPLE 2

The detergent compositions shown in Table 2 were tested. The results shown in Table 2 were obtained.

Table 2

| | Detergents | | | | |
|---|---|---|---|---|---|
| | F | G | H | I* | K* |
| | | | (control) | (control) | (control) |
| LAS dibutylisopropanolamine salt | 30% | — | — | — | — |
| LAS diethylisopropanolamine salt | — | 30% | — | — | — |
| LAS monoisopropanolamine salt | — | — | 30% | — | — |
| lauryl diethanolamide | 15% | 15% | 15% | — | — |
| 2-ethylhexyl sulfosuccinate | 20% | 20% | 20% | — | — |
| petroleum type solvent | 35% | 35% | 35% | — | — |
| water solubility (maximum % by weight) at 1% concentration | 0.55 | 0.45 | 0.1 | 0.30 | 0.23 |
| water solubility (maximum % by weight) at 10% concentration | 15 | 13 | 2 | 10 | 11 |
| detergency (1% detergent solution) | 75 | 80 | 30 | 55 | 50 |
| state of solution (composition) | trans-parent | trans-parent | trans-parent | trans-parent | trans-parent |

I*: A commercially available product comprising, as main components, potassium branched alkylbenzenesulfonate, polyoxyethylene nonylphenyl ether and fatty acid sorbitan ester.
K*: A product comprising, as main components, petroleum sulfonate diethanolamine salt, fatty acid diethanolamide and polyoxyethylene nonylphenyl ether.

As will be apparent from the results shown in Table 2, LAS monoisopropanolamine salt cannot be conveniently used because it has a highly hydrophilic property and is poorly soluble in the organic solvent. On the other hand, LAS dibutylisopropanolamine salt and LAS diethylisopropanolamine salt have good properties.

EXAMPLE 3

Detergents A, B, C and E used in Example 1 were tested with respect to the temperature dependency of the water solubility property thereof.

Figure 1:
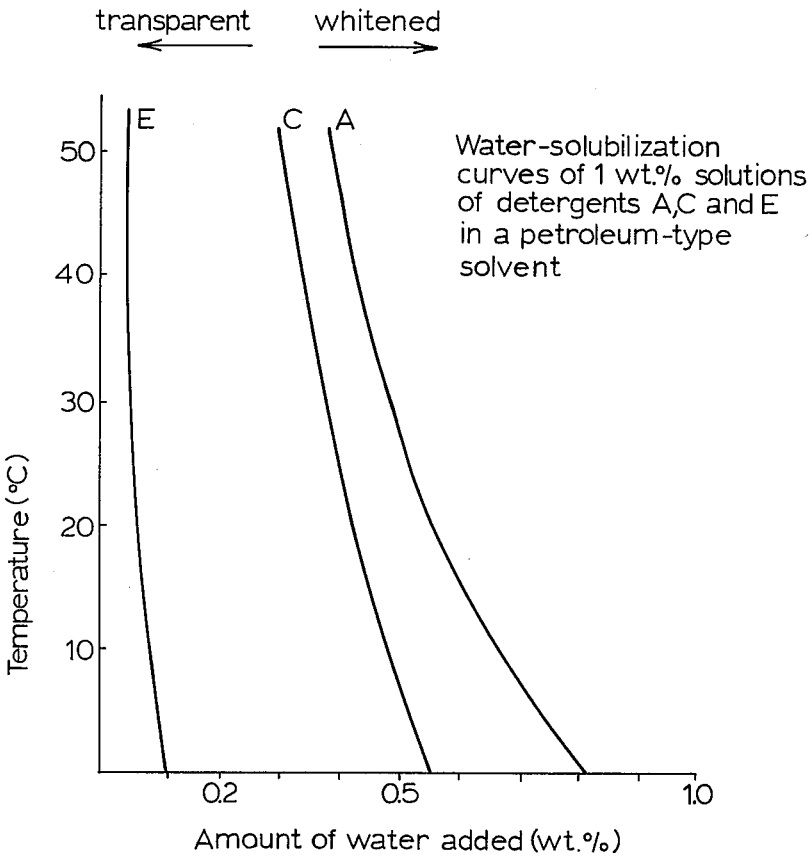
FIG. 1 is a graph illustrating the temperature dependency of the water solubility in 1% detergent solutions of detergents A, C and E in a petroleum type solvent.
Figure 2:
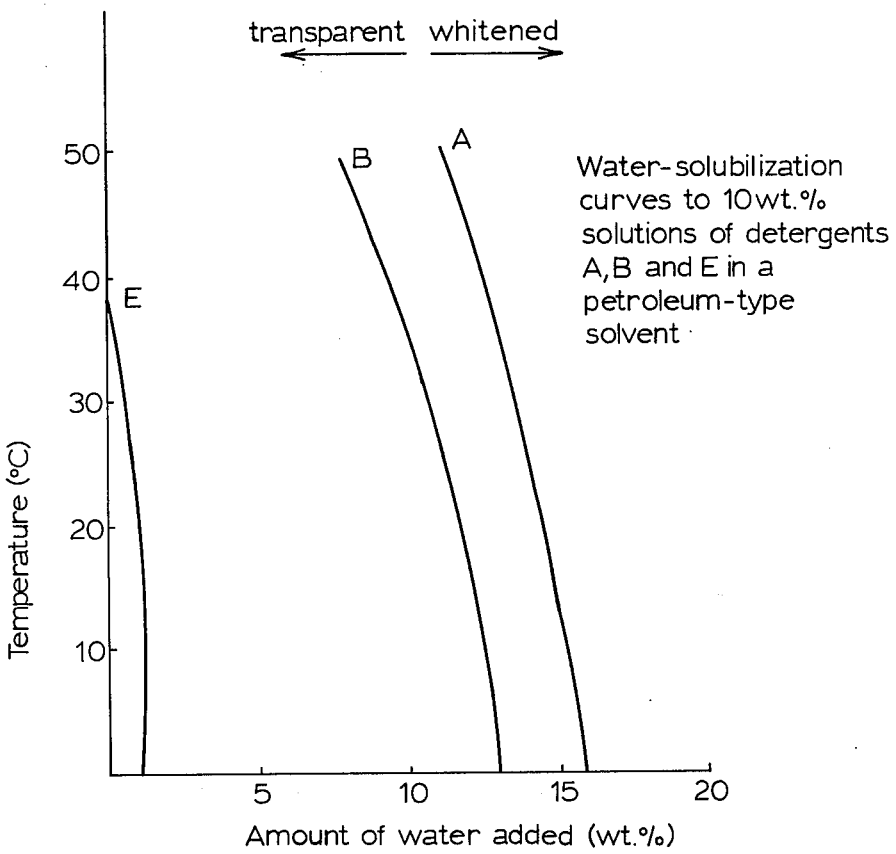
FIG. 2 is a graph illustrating the temperature dependency of the water solubility in 10% detergent solutions of detergents A, B and E in a petroleum type solvent.

In FIGS. 1 and 2, in the regions to the left of the respective curves, the detergent solution was transparent, whereas in the regions to the right of the respective curves the detergent solution was white turbid.

The embodiments of the invention in which an exclusive property or privilege is claimed are defined as follows:

1. A dry cleaning detergent composition consisting essentially of (A) from 5 to 50 percent by weight of a salt, or a mixture of salts, of a linear long-chain alkylbenzenesulfonic acid having 10 to 16 carbon atoms in the alkyl group, with a dialkylalkanolamine having the formula (I):

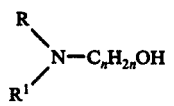

(I)

wherein R and $R^1$, which can be the same or different, are linear or branched alkyls having 2 to 4 carbon atoms and $n$ is 2 or 3;

(B) from 30 to 60 percent by weight of one or a mixture of surface active agents soluble in the organic solvent C and effective for dry cleaning selected from the group consisting of polyoxyethylene nonylphenyl ethers having 2 to 20 moles of added ethylene oxide units, polyoxyethylene alkyl ethers having 2 to 20 moles of added ethylene oxide units and $C_{10}$ to $C_{20}$ alkyl group, fatty acid sorbitan esters, fatty acid alkylolamides derived from $C_{10}$ to $C_{20}$ fatty acids and an alkylolamine selected from the group consisting of monoethanolamine, diethanolamine, monoisopropanolamine and diisopropanolamine, dialkylsulfosuccinic acid salts in which the alkyl group has 6 to 10 carbon atoms, alkylbenzenesulfonic acid salts and petroleum sulfonates wherein the counter ion of said salts is sodium, potassium or lower alkanolamine selected from the group consisting of monoethanolamine, diethanolamine, triethanolamine, monoisopropanolamine, diisopropanolamine and triisopropanolamine, the sum of A and B being from about 35 to about 80 percent by weight, based on the total weight of the composition, and (C) the balance is essentially an organic solvent effective for dry cleaning selected from the group consisting of benzine, mineral spirit, perchloroethylene, trichloroethane and carbon tetrachloride.

2. A dry cleaning detergent composition according to claim 1, in which ingredient B is selected from the group consisting of dialkylsulfosuccinates having 6 to 10 carbon atoms in the alkyl group, polyoxyethylene nonylphenol ethers having 2 to 20 moles of added ethylene oxide units, polyoxyethylene alkyl ethers having 2 to 20 moles of added ethylene oxide units and a $C_{10}$ to $C_{20}$ alkyl group, fatty acid alkylolamides derived from a fatty acid having 10 to 20 carbon atoms and an alkylolamine selected from the group consisting of monoethanolamine, diethanolamine, monoisopropanolamine and diisopropanolamine.

3. A dry cleaning detergent composition according to claim 1 containing 10 to 40 percent by weight of ingredient A.

4. A dry cleaning detergent composition according to claim 1 wherein said dialkylalkanolamine is a dialkylisopropanolamine of the formula:

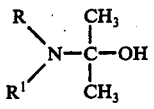

wherein R and $R^1$ are as defined above.

5. A dry cleaning detergent composition according to claim 1 wherein said dialkylalkanolamine has the formula:

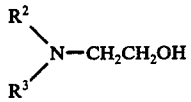

wherein $R^2$ and $R^3$ are linear or branched alkyls having 3 or 4 carbon atoms.

6. A dry cleaning detergent composition according to claim 5 wherein said dialkylalkanolamine is dibutylethanolamine or dipropylethanolamine.

7. A dry cleaning detergent composition according to claim 1 in which the linear long-chain alkylbenzenesulfonic acid has from 12 to 14 carbon atoms in the alkyl group.

8. A dry cleaning detergent composition according to claim 1 containing from 10 to 40 percent by weight of ingredient A and ingredient A is from 30 to 70 percent by weight of the sum of ingredient A plus ingredient B.

* * * * *